US005944105A

United States Patent [19]

Nguyen

[11] Patent Number: 5,944,105

[45] Date of Patent: Aug. 31, 1999

[54] WELL STABILIZATION METHODS

[75] Inventor: Philip D. Nguyen, Lawton, Okla.

[73] Assignee: Halliburton Energy Services, Inc., Duncan, Okla.

[21] Appl. No.: 08/967,420

[22] Filed: Nov. 11, 1997

[51] Int. Cl.[6] ..... E21B 7/18; E21B 43/04

[52] U.S. Cl. ..... 166/278; 166/281; 175/67

[58] Field of Search ..... 166/278, 295, 166/276, 281, 283, 293; 175/53, 67

[56] References Cited

U.S. PATENT DOCUMENTS

| | | | |
|---|---|---|---|
| 1,642,245 | 9/1927 | Judy | 166/278 |
| 2,213,962 | 9/1940 | Layne | 166/278 |
| 2,310,397 | 2/1943 | Coberly | 166/278 |
| 2,652,117 | 9/1953 | Arendt et al. | 166/278 |
| 4,042,032 | 8/1977 | Anderson et al. . | |
| 4,066,127 | 1/1978 | Harnsberger | 166/278 |
| 4,070,865 | 1/1978 | McLaughlin . | |
| 4,829,100 | 5/1989 | Murphey et al. . | |
| 4,888,240 | 12/1989 | Graham et al. . | |
| 4,934,466 | 6/1990 | Paveliev et al. . | |
| 5,058,676 | 10/1991 | Fitzpatrick et al. . | |
| 5,128,390 | 7/1992 | Murphey et al. . | |
| 5,218,038 | 6/1993 | Johnson et al. . | |
| 5,255,741 | 10/1993 | Alexander | 166/278 |
| 5,316,792 | 5/1994 | Harry et al. . | |
| 5,366,030 | 11/1994 | Pool, II et al. . | |
| 5,420,174 | 5/1995 | Dewprashad . | |
| 5,425,994 | 6/1995 | Harry et al. . | |

*Primary Examiner*—Frank Tsay
*Attorney, Agent, or Firm*—Robert A. Kent

[57] ABSTRACT

The present invention relates to methods for stabilizing incompetent or otherwise unstable hydrocarbon producing subterranean zones or formations penetrated by a wellbore during drilling. The methods basically comprise drilling the wellbore into an unstable hydrocarbon producing subterranean zone or formation when it is encountered, pumping a fluid through a well stabilization tool while moving the tool through the portion of the wellbore in the unstable zone or formation whereby fluid jets formed by the well stabilization tool enlarge the diameter of the wellbore by fluid jet erosion, pumping a hardenable permeable material through the well stabilization tool while moving the tool through the enlarged portion of the wellbore whereby the enlarged portion is filled with the hardenable permeable material, allowing the permeable material to harden and then drilling the wellbore through the hardened permeable material and producing hydrocarbons therefrom.

19 Claims, 4 Drawing Sheets

WELL STABILIZATION METHODS

BACKGROUND OF THE INVENTION

1. Field of the Invention

The present invention relates to methods for enlarging and placing a hardenable permeable material in a wellbore which penetrates an unstable hydrocarbon producing subterranean zone or formation during drilling.

2. Description of the Prior Art

In the drilling of a wellbore with a rotary drill bit, weight is applied to the drill string (a string of connected drill pipe sections) while the drill bit is rotated. A fluid, often referred to as drilling fluid or drilling mud, is circulated through the drill string, through the drill bit and upwardly to the surface through the annulus between the drill string and the walls of the wellbore. The drilling fluid cools the drill bit, removes cuttings from the wellbore and maintains hydrostatic pressure on pressurized subterranean formations.

During the drilling of a wellbore, the wellbore may penetrate incompetent or otherwise unstable subterranean zones or formations such as unconsolidated sands or shales. Such unstable zones or formations can have very high permeabilities whereby severe drilling fluid losses occur into the zones or formations. Also, the zones or formations can cave in, slough off or wash out due to the flow of drilling fluid through the wellbore which causes the wellbore to enlarge. This, in turn, can cause the drill string to become stuck as well as a variety of other severe problems. The zones or formations can also be charged with a fluid, e.g., water, which flows into the wellbore making drilling difficult.

In order to solve the problems caused by an unstable subterranean zone or formation, the portion of the wellbore penetrating the zone or formation has heretofore been enlarged and filled with cementitious material. After the cementitious material has set, the wellbore has been drilled through the cementitious material leaving a cementitious sheath in the wellbore for preventing undesired fluid influx, fluid losses, cave-ins, etc. While such techniques have been utilized successfully, they have heretofore required the use of many different tools, the necessity of making many trips in and out of the wellbore, and a great deal of time and expense to complete.

Thus, there is a need for improved methods for stabilizing unstable hydrocarbon producing subterranean zones or formations penetrated by a wellbore which do not require the use of many different tools, numerous drill string and/or work string trips, long delays and the like.

SUMMARY OF THE INVENTION

The present invention provides improved well stabilization methods which meet the needs described above and obviate the shortcomings of the prior art.

The well stabilization methods of the present invention can be used to stabilize an unstable hydrocarbon producing zone or formation encountered in the drilling of a wellbore whether vertical or horizontal, without removing the drill string and drill bit from the wellbore or only doing so a minimum of times. That is, a well stabilization tool can be connected in a drill string adjacent the drill bit before the wellbore is drilled. The drilling of the wellbore can then proceed in the normal manner until an unstable hydrocarbon producing zone or formation is reached. The well stabilization tool is then activated and used to enlarge the portion of the wellbore which penetrates the unstable zone or formation and to fill the enlarged wellbore with a hardenable permeable material. After the permeable material has hardened, the wellbore is drilled through the hardened material and operations may be initiated.

The well stabilization tool used as described above is basically comprised of a tubular housing having a fluid flow passage extending therethrough adapted to be connected in a drill string. The housing includes one or more outwardly extending enlarged portions formed thereon whereby the outer surfaces of the enlarged portions are positioned in close proximity to the walls of the wellbore drilled with the drill string and drill bit and having one or more lateral fluid jet forming ports extending from the fluid flow passage through the enlarged portions of the housing to the exterior thereof. A valve sleeve is releasably and slidably disposed within the fluid flow passage of the housing which is movable between a first position whereby the fluid jet forming ports are closed by the valve sleeve and fluid pumped through the drill string is free to flow through the fluid flow passage of the housing by way of the interior of the valve sleeve and a second position whereby the fluid jet forming ports are opened.

The tool is activated by an activator plug which is flowed through the drill string into the housing where it releasably engages and plugs the valve sleeve causing it to move from the first position to the second position whereby fluid pumped through the drill string is forced through the fluid jet forming ports of the tool. When the activator plug is retrieved, the valve sleeve is pulled back to the first position so that fluid again flows through the tool.

The methods of using the above described tool basically comprise the steps of placing the tool in a drill string near the drill bit, drilling a wellbore with the valve sleeve of the tool in the first position whereby fluid flows through the tool and through the drill bit until the wellbore has been drilled into an unstable hydrocarbon producing subterranean zone or formation. The tool is then activated by means of the above mentioned activator plug and the valve sleeve is moved to its second position whereby fluid flows through the jet forming ports of the tool. Fluid is pumped through the drill string and through the tool at a rate while moving the tool through the portion of the wellbore in the unstable zone or formation whereby the diameter of the wellbore is enlarged by fluid jet erosion. A hardenable permeable material is then pumped through the drill string and through the jet forming ports of the tool at a rate while moving the tool through the enlarged portion of the wellbore whereby the enlarged portion is filled with the permeable material. While the permeable material is allowed to harden, the activator plug is retrieved which moves the valve sleeve back to its first position after which the wellbore is drilled through the hardened material and hydrocarbon production operations then are initiated.

An alternate well stabilization tool of this invention for enlarging and placing a permeable material in an unstable hydrocarbon producing subterranean zone or formation penetrated by a wellbore requires only a minimum number of trips in and out of the wellbore. That is, after the wellbore penetrates an unstable zone or formation, the drill string is removed from the wellbore, the drill bit is replaced with the well stabilization tool and the tool and drill string are placed back in the wellbore. The tool is used to enlarge and place the hardenable permeable material in the unstable zone or formation whereupon the drill string is removed from the wellbore and the well stabilization tool is replaced with the drill bit. After the drill string and drill bit have been placed back in the wellbore, the wellbore is drilled through the hardened permeable material and production operations may be initiated.

The well stabilization tool used as described above is basically comprised of a tubular housing having a longitudinal fluid flow passage extending therethrough and having a plurality of lateral threaded openings extending from the fluid flow passage to the exterior of the housing. The housing includes a seat for receiving an activated plug and a plurality of tubular threaded arm members are threadedly connected within the threaded openings in the housing. The threaded arm members have fluid flow passages extending therethrough and have fluid jet forming ports communicating with the passages at their exterior ends. The arm members are of lengths such that the fluid jet forming ports at the exterior ends thereof are positioned in close proximity to the walls of the wellbore.

It is, therefore, a general object of the present invention to provide improved well stabilization methods.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 6 is a side cross-sectional view of the valve sleeve of the tool of FIG. 1.

DESCRIPTION OF PREFERRED EMBODIMENTS

Figure 1:
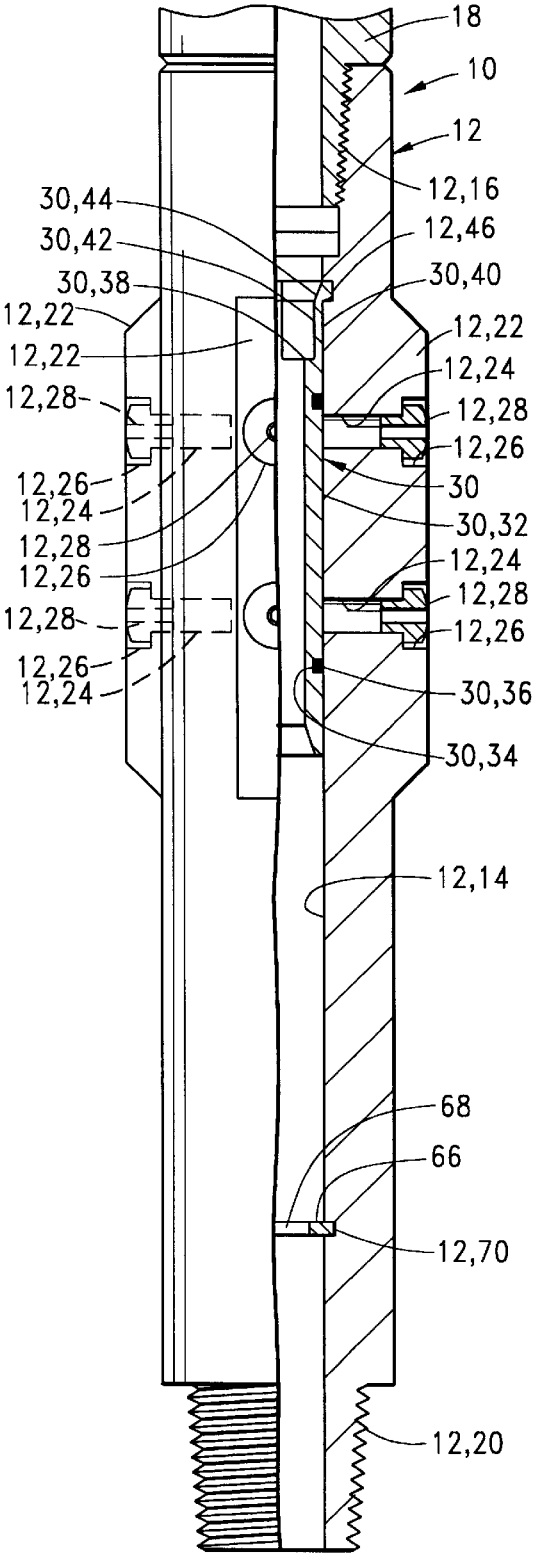
FIG. 1 is a side partially sectional view of a well stabilization tool switch for use in the present invention.

Referring now to the drawings and particularly FIGS. 1–6, an embodiment of a well stabilization tool suitable for use in the present invention is illustrated and generally designated by the numeral 10. The tool 10 is comprised of a tubular housing 12 having a longitudinal fluid flow passage 14 extending therethrough. The housing 12 includes a conventional female threaded connection 16 at the upper end thereof for threaded connection to a drill string 18. As is well understood by those skilled in the art, the drill string 18 is made up of a plurality of drill pipe sections threadedly connected end to end. A complimentary male threaded connection 20 is provided at the lower end of the housing 12 4 for connecting the tool 10 to a drill pipe section, a drill collar or the drill bit (not shown).

The housing 12 includes four outwardly extending enlarged rib portions 22 which are positioned in close proximity to the walls of a wellbore drilled with the drill string 18 and a drill bit (not shown) connected below the tool 10. As will be understood by those skilled in the art, the housing 12 can include a single cylindrical enlarged portion or two or more enlarged rib portions 22 as desired. The housing 12 further includes a plurality of fluid jet forming passages or ports 24 formed therein extending from the fluid flow passage 14 of the housing 12 through the enlarged rib portions 22 thereof to the exterior of the housing 12. Preferably, the lateral ports 24 are arranged in two groups of three or four equally spaced ports 24 (two groups of four ports 24 are illustrated in the drawings). Also, the ports 24 preferably intersect enlarged counter bores 26 in the housing 12 adjacent the exterior thereof and include fluid jet forming nozzles 28 threadedly connected therein. In an alternative embodiment (not shown), the nozzles 28 may extend through the full length of the lateral ports 24 to the fluid passage 14 for preventing erosion of the housing 12 and to increase the fluid jetting efficiency therefrom. As will be described further hereinbelow, some of the ports 24 can include plugs instead of nozzles 28, and the sizes of the flow passages through the nozzles 28 can be varied as required to produce the desired number and velocities of the fluid jets issuing from the tool 10.

Figure 2:
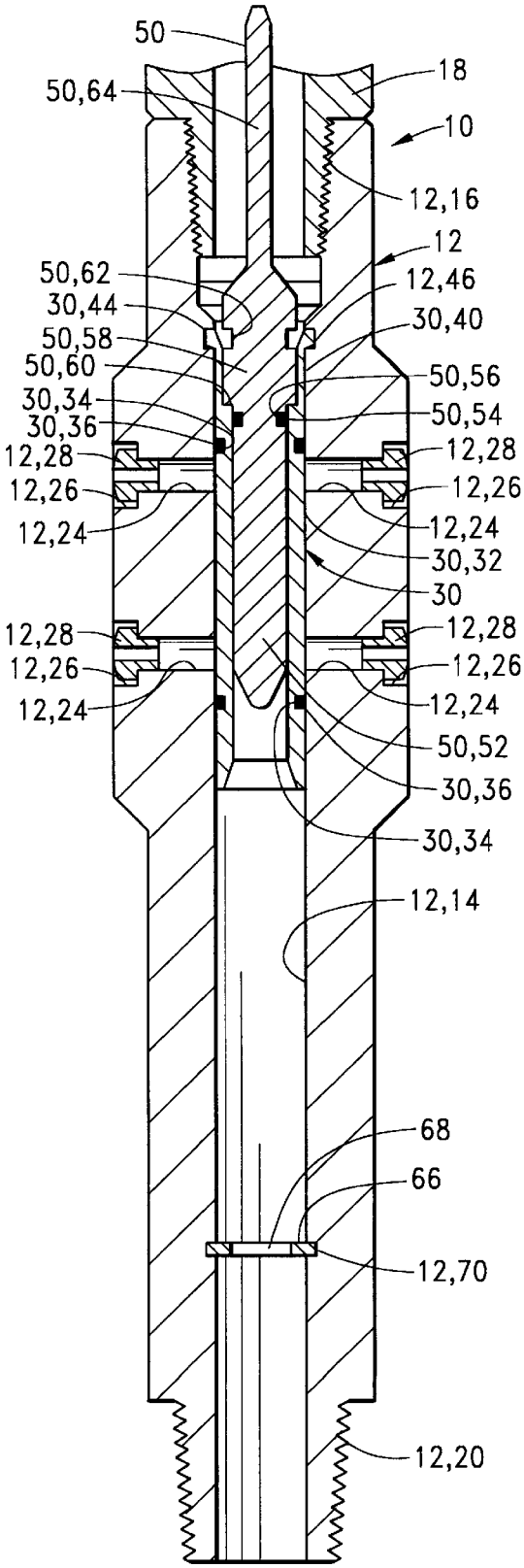
FIG. 2 is a side cross-sectional view of the tool of FIG. 1 after an activator plug has engaged a valve sleeve in the tool.
Figure 5:
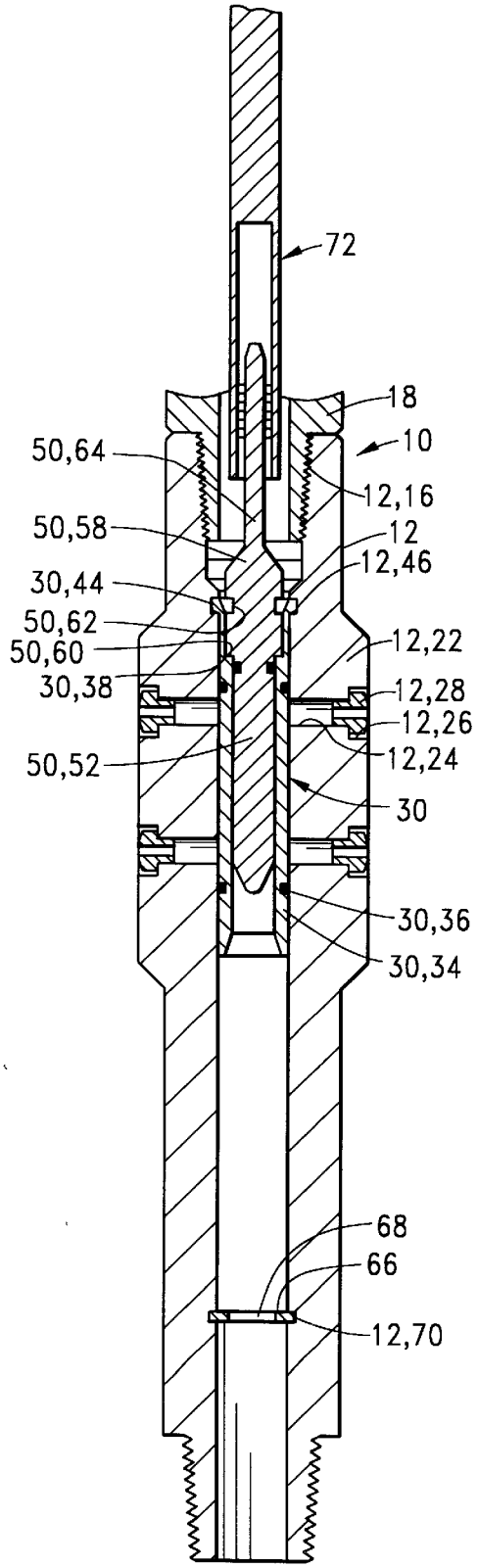
FIG. 5 is a cross-sectional view of the tool of FIG. 1 after the activator plug and valve sleeve have been moved upwardly within the tool as the activator plug is being retrieved therefrom.

The tool 10 includes a valve sleeve 30 releasably and slidably disposed within the fluid flow passage 14 of the housing 12. The valve sleeve 30 includes an elongated cylindrical body portion 32 having a pair of longitudinally spaced grooves 34 formed in the exterior surface thereof with conventional O-ring seals 36 disposed therein. As shown in FIGS. 1, 2 and 5, the grooves 34 in the valve sleeve 30 are spaced a distance apart whereby the O-ring seals bracket the lateral fluid jet forming ports 24 when the valve sleeve is in its first position as shown in FIGS. 1, 2 and 5.

Figure 7:
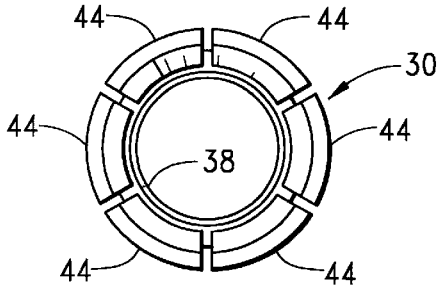
FIG. 7 is a top view of the valve sleeve of FIG. 6.

As shown best in FIGS. 6 and 7, the upper end portion of the valve sleeve 30 includes an internal activator plug receiving seat 38 and a collet 40 comprised of a plurality of collet fingers 42 extending upwardly from the receiving seat 38. Each of the collet fingers 42 of the collet 40 have collet heads 44 at the upper ends thereof. The collet heads 44 protrude radially outwardly and the external surfaces of the collet fingers 42 below the heads 44 are recessed whereby the lower surfaces 43 of the collet heads 44 are inclined (as shown in FIG. 6). Alternatively, the collet heads 44 may include additional collet fingers (not shown) extending upwardly therefrom, wherein the collet fingers (not shown) are attached to one another at an end distant from the collet heads 44. When the valve sleeve 30 is in its first position within the housing 12 as illustrated in FIGS. 1, 2 and 5, the collet heads 44 of the collet 40 extend within a complimentary groove 46 in the housing 12 whereby the valve sleeve 30 is releasably retained in the first position.

When it is desired to activate the tool 10, that is, move the valve sleeve 30 to a second position within the flow passage 14 of the housing 12 whereby the fluid jet forming ports are opened, an activator plug 50 is flowed through the drill string 18 and housing 12 into releasable engagement with the valve sleeve 30 as illustrated in FIG. 2.

The activator plug 50 includes an elongated nose portion 52 which is of an external size slightly smaller than the internal diameter of the valve sleeve 30. The nose portion 52 includes an O-ring groove 54 with an O-ring 56 disposed therein for providing a seal between the external surface of the nose portion 52 and the internal surface of the valve sleeve 30. Immediately above the nose portion 52 of the activator plug 50 is an enlarged portion 58 which forms an annular shoulder or seat 60 on the activator plug 50 complimentary to the annular seat 38 within the valve sleeve 30.

An annular groove 62 is formed in the enlarged portion 58 of the activator plug 50 which is positioned to receive the collet heads 44 of the collet 40 as will be described hereinbelow. Finally, the activator plug 50 includes a reduced diameter upwardly extending fishing neck 64 connected to the enlarged portion 58.

Figure 3:
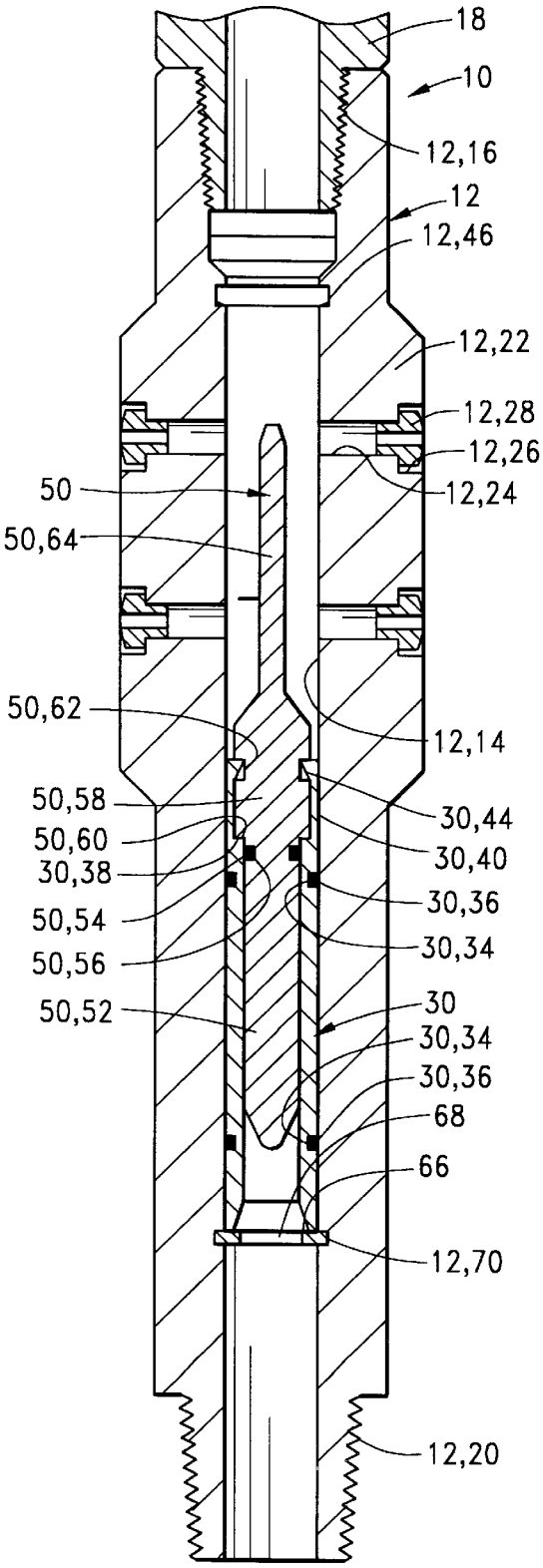
FIG. 3 is a side cross-sectional view of the tool of FIG. 1 after the activator plug and valve sleeve have been moved downwardly in the tool by fluid pressure.

When the activator plug 50 is flowed by drilling fluid pumped through the drill string 18 and housing 12 of the tool 10 into engagement with the valve sleeve 30 as illustrated in FIG. 2, the seat 60 of the activator plug 50 lands on the seat 38 of the valve sleeve 30 thereby plugging the interior of the valve sleeve 30 and moving it to a second position as shown in FIG. 3. That is, the activator plug 50 seals the interior of the valve sleeve 30 whereby fluid pressure produced by drilling fluid pumped through the drill string and into the housing 12 forces the activator plug 50 and valve sleeve 30 to move downwardly in the passage 14 of the housing 12. As the activator plug 50 and valve sleeve 30 move downwardly, the collet heads 44 of the collet 40 are pulled out of the annular groove 46 in the housing 12 whereby the valve sleeve 30 is released from its first position. Simultaneously, the collet heads 44 are deformed into the annular groove 62 in the enlarged portion 58 of the activator plug 50 as illustrated in FIGS. 3 and 4 whereby the valve sleeve 30 is releasably engaged by the activator plug 50.

As shown in FIG. 3, the downward movement of the activator plug 50 and valve sleeve 30 is terminated when the valve sleeve reaches its second position by an annular shoulder 66 extending into the fluid flow passage 14 of the housing 12. In the form illustrated in the drawings, the annular shoulder 66 is formed by a snap ring 68 disposed within a groove 70 in the housing 12. As will be understood, when the valve sleeve 30 is in its second position shown in FIG. 3, fluid pumped through the drill string and into the housing 12 of the tool 10 flows through the fluid jet forming ports 24 of the housing 12.

Figure 4:
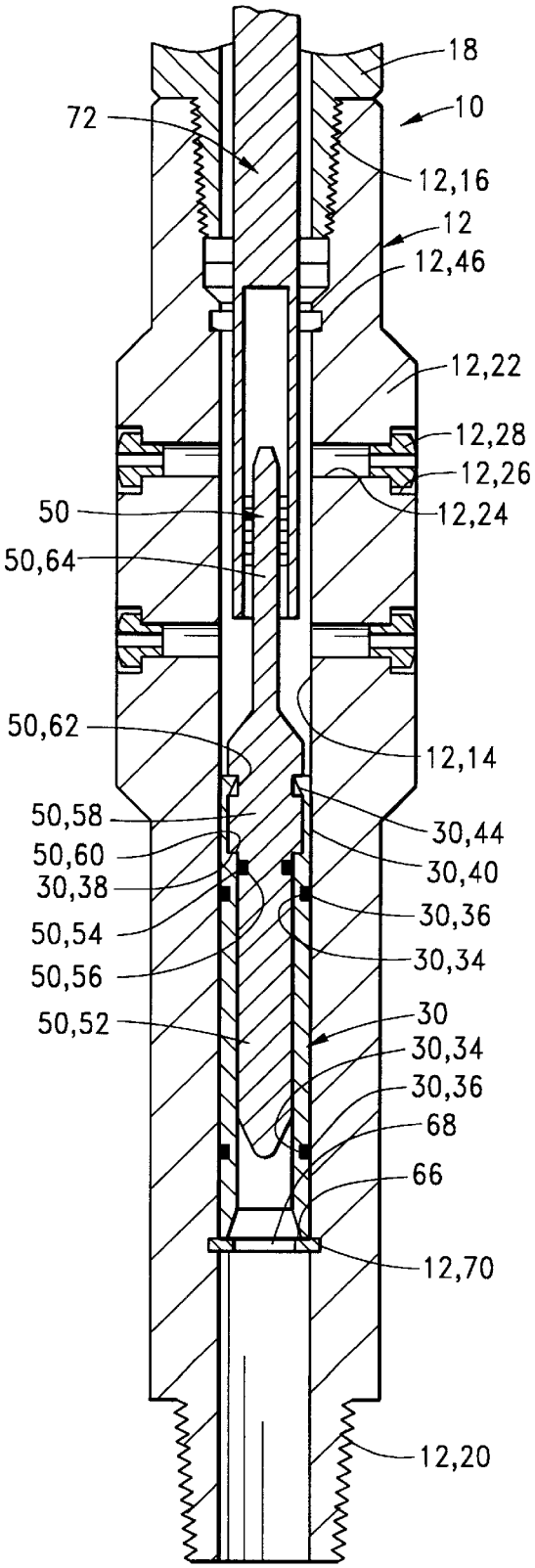
FIG. 4 is a side cross-sectional view of the tool of FIG. 1 after a fishing tool has engaged the fishing neck of the activator plug within the tool.

When it is desired to move the valve sleeve 30 of the tool 10 back to its first position and remove the activator plug 50 from the interior of the housing 12 of the tool 10 whereby normal wellbore drilling can be resumed, a fishing tool 72 is lowered through the drill string 18 by means of a wire line, a slick line or a working string into the flow passage 14 of the housing 12 whereby the fishing neck 64 of the activator plug 50 is engaged by the fishing tool 72 as shown in FIG. 4. Thereafter, the fishing tool 72 and activator plug 50 are raised whereby they are moved upwardly within the housing 12. As the activator plug is moved upwardly, the valve sleeve 30 is pulled with it since the collet heads 44 of the collet 40 of the valve sleeve 30 extend into the annular groove 62 of the activator plug 50 and are engaged thereby. When the activator plug 50 and the valve sleeve 30 are pulled upwardly to the point where the valve sleeve 30 reaches its first position, the collet heads 44 of the valve sleeve 30 spring back into the annular groove 46 in the housing 12 and out of the annular groove 62 in the activator plug 50. This releases the activator plug 50 from the valve sleeve 30 whereby the continued upward movement of the fishing tool 72 and activator plug 50 removes the activator plug 50 from the tool 10. The fishing tool 72 and activator plug 50 are then lifted to the surface and removed from the drill string.

Figure 8:
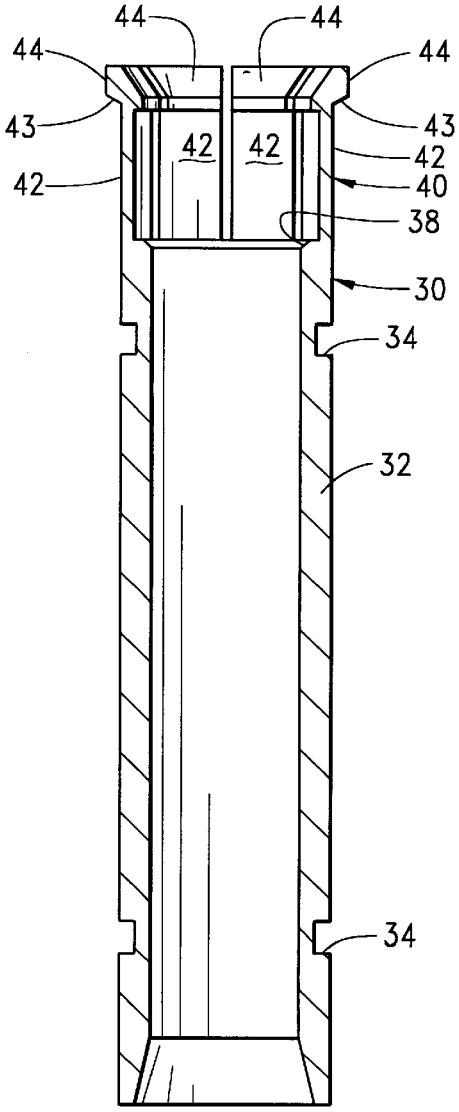
FIGS. 8–13 are sequential schematic illustrations of a wellbore drilled through an unstable hydrocarbon producing zone or formation and the stabilization of the wellbore using the tool of FIG. 1 and the method of the present invention.
Figure 8:
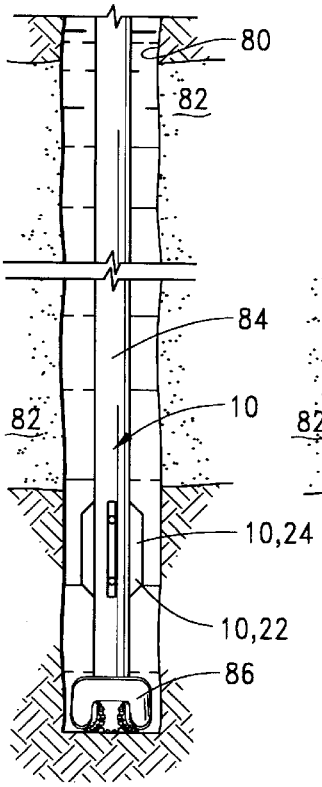

Referring now to FIGS. 8–13, the various steps involved in stabilizing an unstable hydrocarbon producing subterranean zone or formation penetrated by a wellbore during its drilling using the well stabilization tool 10 are schematically illustrated. Referring specifically to FIG. 8, a wellbore 80 which has been drilled into an unstable hydrocarbon producing subterranean zone or formation 82 with a drill string 84 having the tool 10 and a drill bit 86 connected thereto is illustrated. As will be understood, the well stabilization tool 10 is placed in the drill string prior to the commencement of drilling with the valve sleeve 30 in its first position whereby drilling fluid pumped into the drill string 84 during drilling flows through the flow passage 14 of the housing 12 of the tool 10 and through the interior of the valve sleeve 30, through the drill bit 86 and upwardly through the annulus between the drill string 84 and wellbore 80. When the wellbore 80 has been drilled to a depth whereby it has penetrated or passed through the unstable producing zone or formation 82, the drilling of the wellbore is stopped and the activator plug 50 is placed into the drill string 84 at the surface. The activator plug 50 is caused to flow by pumped drilling fluid through the drill string 84 and into the housing 12 of the tool 10 where it engages the valve sleeve 30 of the tool 10, moves it from its first position to its second position and opens the lateral fluid jet forming ports 24.

Figure 9:
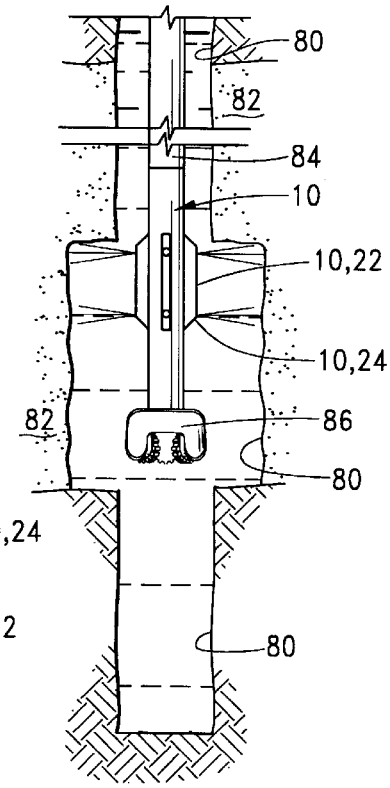
Figure 10:
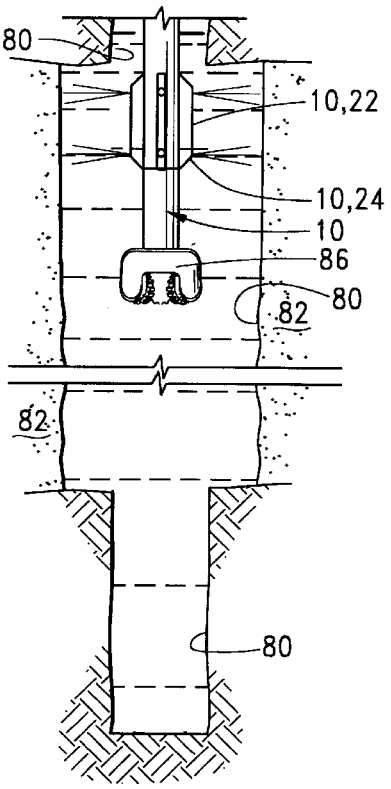

Referring now to FIG. 9, after the fluid jet forming ports 24 are opened, drilling fluid is pumped through the drill string and through the fluid jet forming ports 24 of the tool 10 at a rate while moving the tool 10 through the portion of the wellbore 80 in the unstable hydrocarbon producing zone or formation 82 whereby the diameter of the wellbore 80 is enlarged by fluid jet erosion. That is, the drilling fluid jets issuing from the ports 24 of the tool 10 impinge on the walls of the wellbore 80 in the unstable zone or formation 82 causing the wellbore 80 to be eroded and enlarged as illustrated in FIGS. 9 and 10.

Figure 11:
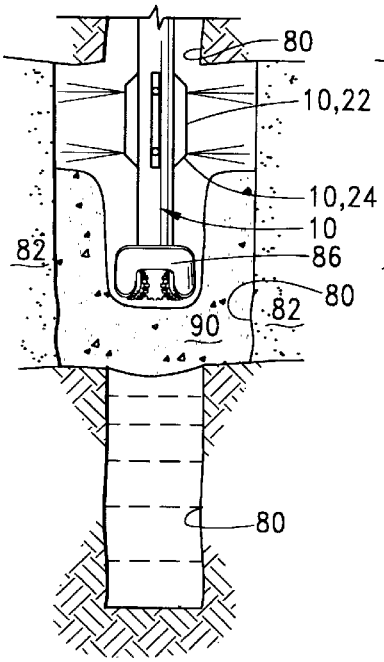
Figure 12:
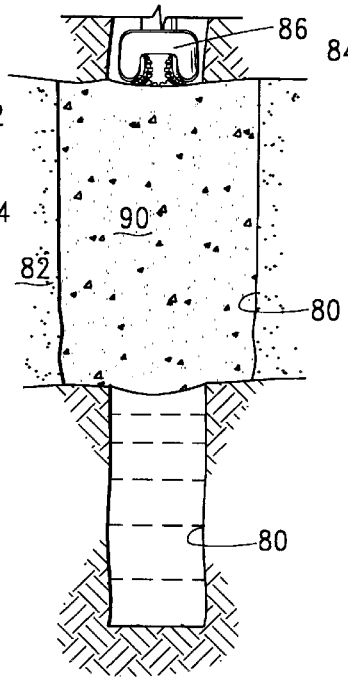
Figure 13:
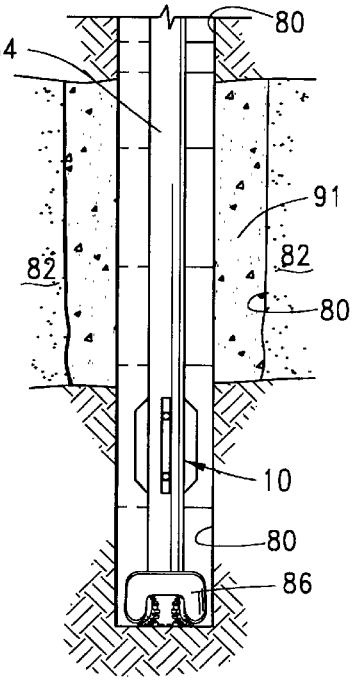

Referring now to FIG. 11, once the portion of the wellbore 80 penetrating the unstable zone or formation 82 has been enlarged, a hardenable permeable material is pumped through the drill string 84 and through the jet forming ports 24 of the tool 10 at a rate while moving the tool 10 through the enlarged portion of the wellbore 80 whereby the enlarged portion of the wellbore is filled with a quantity 90 of permeable material as shown in FIGS. 11 and 12. As shown in FIG. 12, when the enlarged portion of the wellbore 80 has been completely filled with the hardenable permeable material, the drill string 84, the tool 10 and drill bit 86 are moved to a position in the wellbore 80 above the enlarged portion containing the hardenable permeable material and the permeable material is allowed to harden. While the permeable material is hardening, the activator plug 50 is removed from the tool 10 and drill string 84 which closes the ports 24 of the tool 10. Thereafter, the wellbore 80 is redrilled through the hardened material as shown in FIG. 13 and normal production operations may be initiated. The permeable sheath 91 which remains in the unstable zone or formation stabilizes the wellbore passing therethrough and prevents such problems as cave ins, wash outs, etc.

As will be understood by those skilled in the art, a variety of hardenable permeable materials can be utilized in accordance with this invention for stabilizing an unstable hydrocarbon producing subterranean zone or formation.

The particulate material utilized in the hardenable permeable material in accordance with the present invention is preferably graded sand which is sized based on a knowledge of the size of the formation fines and sand in the unconsolidated zone to prevent the formation fines and sand from passing through the consolidated permeable sand mass formed. The sand generally has a particle size in the range of from about 8 to about 70 mesh, U.S. Sieve Series. Preferred sand particle size distribution ranges are one or more of 10–20 mesh, 20–40 mesh, 40–60 mesh or 50–70 mesh, depending on the particle size and distribution of the formation fines and sand to be stabilized by the particulate material. It is to be understood that the particulate material also may comprise for example, glass beads, metal beads, polymer beads, sintered bauxite, ceramic beads or the like.

The graded sand can be pre-coated and mixed with a carrier liquid to form a slurry for introduction into the unstable zone or formation or the graded sand can be both coated and slurried at the well site. The hardenable resin compositions which are useful for coating sand and consolidating it into a hard permeable mass are generally comprised of a hardenable organic resin and may include a resin-to-sand coupling agent. Such resin compositions are well known to those skilled in the art as is their use for consolidating sand into hard permeable masses. A number of such compositions are described in detail in U.S. Pat. No. 4,042,032 issued to Anderson, et al.; U.S. Pat. No. 4,070,865 issued to McLaughlin; U.S. Pat. No. 4,829,100 issued to Murphey, et al.; U.S. Pat. No. 4,888,240 issued to Graham et al.; U.S. Pat. No. 5,058,676 issued to Fitzpatrick, et al.; U.S. Pat. No. 5,128,390 issued to Murphey, et al.; U.S. Pat. No. 5,218,038 issued to Johnson et al.; U.S. Pat. No. 5,316,792 issued to Harry et al.; U.S. Pat. No. 5,420,174 issued to Dewprashad and U.S. Pat. No. 5,425,994 issued to Harry et al, the entire disclosures of which are incorporated herein in their entirety by reference.

Examples of hardenable organic resins which are particularly suitable for use in accordance with this invention are novolac resins, polyepoxide resins, polyester resins, phenol-aldehyde resins, urea-aldehyde resins, furan resins and urethane resins. These resins are available at various viscosities depending upon the molecular weights of the resins. The preferred viscosity of the organic resin used is generally in the range of from about 1 to about 1000 centipoises at 80° F. However, as will be understood, resins of higher viscosities can be utilized when mixed or blended with one or more diluents. Diluents which are generally useful with all of the various resins mentioned above include phenols, formaldehydes, furfuryl alcohol and furfural.

A resin-to-sand coupling agent may be utilized in the hardenable resin compositions to promote coupling or adhesion to sand or other similar particulate materials. Particularly suitable coupling agents are aminosilane compounds or mixtures of such compounds. A preferred such coupling agent is N-Beta-(aminoethyl)-gamma-aminopropyltrimethoxysilane.

The hardenable resin composition which is used may be caused to harden by allowing it to be heated in the formation or by contacting it with a hardening agent. When a hardening agent is utilized, it can be included in the resin composition (internal hardening agent) or the resin composition can be contacted with the hardening agent after the resin composition coated particulate material has been placed in the unstable subterranean formation (external hardening agent). An internal hardening agent is selected for use that causes the resin composition to harden after a period of time sufficient for the resin composition coated particulate material to be placed in the unstable subterranean zone. Retarders or accelerators to lengthen or shorten the cure times can also be utilized. When an external hardening agent is used, the hardenable resin composition coated particulate material is first placed in a zone followed by an over-flush solution containing the external hardening agent. Examples of suitable internal hardening agents which can be used include hexachloroacetone, 1,1,3-trichlorotrifluoroacetone, benzotrichloride, benzylchloride and benzalchloride. Examples of external hardening agents which can be used include benzotrichloride, acetic acid, formic acid and inorganic acids such as hydrochloric acid. The hardenable resin compositions can also include surfactants, dispersants and other additives which are well known to those skilled in the art.

The resin coated particulate material used in accordance with this invention to form the hardenable permeable material can be prepared in accordance with conventional batch mixing techniques followed by the suspension of the resin coated particulate material in a viscous carrier liquid. Alternatively, the carrier liquid containing hardenable resin composition coated particulate material can be prepared in a substantially continuous manner such as in accordance with the methods disclosed in U.S. Pat. No. 4,829,100 issued to Murphey, et al.; or U.S. Pat. No. 5,128,390 issued to Murphey, et al.

The carrier liquid utilized, which can also be used to fracture the unstable subterranean zone or formation if desired, can be any of the various viscous carrier liquids or fracturing fluids utilized heretofore including gelled water, oil base liquids, foams or emulsions. The foams utilized have generally been comprised of water based liquids containing one or more foaming agents foamed with a gas such as nitrogen. The emulsions have been formed with two or more immiscible liquids. A particularly useful emulsion is comprised of a water based liquid and a liquified normally gaseous fluid such as carbon dioxide. Upon pressure release, the liquified gaseous fluid vaporizes and rapidly flows out of the formation.

The most common carrier liquid utilized heretofore which is also preferred for use in accordance with this invention is comprised of an aqueous liquid such as fresh water or salt water combined with a gelling agent for increasing the viscosity of the liquid. The increased viscosity reduces fluid loss and allows the carrier liquid to transport significant concentrations of hardenable resin composition coated particulate material into the subterranean zone.

A variety of gelling agents have been utilized including hydratable polymers which contain one or more functional groups such as hydroxyl, cis-hydroxyl, carboxyl, sulfate, sulfonate, amino or amide. Particularly useful such polymers are polysaccharides and derivatives thereof which contain one or more of the monosaccharides units galactose, mannose, glucoside, glucose, xylose, arabinose, fructose, glucuronic acid or pyranosyl sulfate. Various natural hydratable polymers contain the foregoing functional groups and units including guar gum and derivatives thereof, cellulose and derivatives thereof, and the like. Hydratable synthetic polymers and co-polymers which contain the above mentioned functional groups can also be utilized including polyacrylate, polymethylacrylate, polyacrylamide, and the like.

Particularly preferred hydratable polymers which yield high viscosities upon hydration at relatively low concentrations are guar gum and guar derivatives such as hydroxypropylguar and carboxymethylguar and cellulose derivatives such as hydroxyethylcellulose, carboxymethylcellulose and the like.

The viscosities of aqueous polymer solutions of the types described above can be increased by combining cross-linking agents with the polymer solutions. Examples of cross-linking agents which can be utilized are multivalent metal salts or compounds which are capable of releasing such metal ions in an aqueous solution.

The above described gelled or gelled and cross-linked carrier liquids can also include gel breakers such as those of the enzyme type, the oxidizing type or the acid buffer type which are well known to those skilled in the art. The gel breakers cause the viscous carrier liquids to revert to thin fluids that can be produced back to the surface after they have been utilized.

The creation of one or more fractures in a hydrocarbon producing zone or formation in order to stimulate the production of hydrocarbons therefrom is well known to those skilled in the art. The hydraulic fracturing process generally involves pumping a viscous liquid containing suspended particulate material into the formation or zone at a rate and pressure whereby fractures are created therein. The continued pumping of the fracturing fluid extends the fractures in the zone and carries the particulate material into the fractures. Upon the reduction of the flow of the fracturing fluid and the reduction of pressure exerted on the zone, the particulate material is deposited in the fractures and the fractures are prevented from closing by the presence of the particulate material therein.

As mentioned, the unstable subterranean zone to be treated can be fractured prior to or during the injection of the hardenable permeable material into the unstable zone, that is, the pumping of the carrier liquid containing the resin coated particulate material into the zone. Upon the creation of one or more fractures, the resin coated particulate material can be pumped into the fractures as well as into the enlarged portion of the wellbore. Upon the hardening of the resin composition, the permeable particulate material in the fractures functions to prop the fractures open as well as to screen out loose or incompetent formation fines and sand.

Thus, the method of stabilizing an unstable hydrocarbon producing subterranean zone or formation penetrated by a wellbore during the drilling of the wellbore with a drill bit connected to a drill string using the tool 10 basically comprises the following steps:

(1) placing the well stabilization tool 10 in the drill string near the drill bit, the tool having a longitudinal fluid flow passage therethrough, having one or more lateral fluid jet forming ports therein and having an internal valve which can be selectively moved between a first position whereby fluid pumped into the drill string is flowed through the fluid flow passage of the tool and through the drill bit and a second position whereby the fluid is flowed through the lateral fluid jet forming ports of the tool;

(2) drilling the wellbore with the valve of the well stabilization tool in its first position until the wellbore has been drilled into the unstable hydrocarbon producing subterranean zone or formation;

(3) moving the valve of the tool from its first position to its second position and pumping fluid through the jet forming ports at a rate while moving the tool through the portion of the wellbore in the unstable hydrocarbon producing zone or formation whereby the diameter of the wellbore is enlarged by fluid jet erosion;

(4) pumping a hardenable permeable material through the drill string and through the jet forming ports of the tool at a desired flow rate while moving the tool through the enlarged portion of the wellbore in the unstable zone or formation whereby the enlarged portion of the wellbore is filled with the permeable material;

(5) moving the valve of the tool back to its first position while the permeable material is allowed to harden; and then (6) drilling the wellbore through the hardened permeable material thereby forming a hardened permeable material sheath in the unstable zone or formation which stabilizes the wellbore and through which hydrocarbons can be produced.

Another example of a well stabilization tool (not illustrated) for enlarging and placing a hardenable permeable material in an unstable subterranean zone or formation penetrated by a wellbore does not include a valve and is adapted to be connected to a drill string in place of the drill bit. That is, when a wellbore has been drilled into an unstable subterranean zone or formation utilizing a drill bit connected to a drill string, the drill string and drill bit are removed from the wellbore and the drill bit is replaced with the tool. In addition, if the drill string does not already include a drill string centralizer, such a centralizer is placed in the drill string adjacent to or near the well stabilization tool. The well stabilization tool is utilized to enlarge the portion of the wellbore penetrating through the unstable zone or formation and to fill the enlarged portion of the wellbore with a hardenable permeable material. While the permeable material is setting, the drill string having the well stabilization tool connected thereto is pulled from the wellbore, the well stabilization tool and drill string centralizer (if not left in the drill string) are removed from the drill string, the drill bit is replaced on the drill string and the drill string and drill bit are placed in the wellbore. The drill string and drill bit are used to drill the wellbore through the set permeable material leaving a permeable sheath in the unstable hydrocarbon producing zone or formation which stabilizes the zone or formation. Thereafter, normal production operations may be initiated.

Thus, the method of stabilizing an unstable hydrocarbon producing subterranean zone or formation penetrated by a wellbore during the drilling of the wellbore with a rotary drill bit connected to a drill string utilizing the alternative embodiment of the well stabilization tool basically comprises the following steps:

(1) removing the drill string and drill bit from the wellbore;

(2) connecting a drill string centralizer and/or the well stabilization tool to the drill string in place of the drill bit, the well stabilization tool comprising, a tubular housing having a longitudinal fluid flow passage extending therethrough, having a threaded drill string connection at the upper end thereof, having a plurality of lateral threaded openings extending from the fluid flow passage to the exterior of the housing and having an annular seat extending into the flow passage below the lateral threaded openings for receiving an activator plug, and a plurality of tubular threaded arm members threadedly connected within the threaded openings in the housing having fluid flow passages therethrough and having fluid jet forming ports communicated with the fluid flow passages at the exterior ends thereof, the arm members being of lengths such that the fluid jet forming ports at the exterior ends thereof are positioned in close proximity to the walls of the wellbore when the tool is connected to the drill string and placed in the wellbore;

(3) placing the drill string, centralizer and well stabilization tool in the wellbore with the tool positioned within the portion of the wellbore in the unstable zone or formation;

(4) flowing an activator plug with fluid pumped through the drill string into the housing of the tool whereby the activator plug lands on the annular shoulder in the housing and the fluid is caused to flow through the tubular arm members and the fluid jet forming ports of the tool;

(5) pumping fluid through the jet forming ports at a rate while moving the tool through the portion of the wellbore in the unstable zone or formation whereby the diameter of that portion of the wellbore is enlarged by fluid jet erosion;

(6) pumping a hardenable permeable material through the drill string and through the fluid jet forming ports at a desired flow rate while moving the tool through the enlarged portion of the wellbore in the unstable zone or formation whereby the enlarged portion of the wellbore is filled with the permeable material;

(7) removing the drill string and well stabilization tool from the wellbore while the permeable material is allowed to set;

(8) reconnecting a drill bit to the drill string and placing the drill string and drill bit in the wellbore; and (9) drilling the wellbore through the set permeable material to thereby form a permeable sheath in the wellbore which stabilizes the wellbore passing through the unstable zone or formation and producing hydrocarbons therefrom.

While the present invention has been illustrated through reference to vertically illustrated wellbores, it is to be understood that the method of the present invention is applicable to wellbores of any orientation, such as horizontal wellbores, which penetrate a hydrocarbon producing unstable zone or formation. The method of the present invention would be performed in a horizontal wellbore in substantially the same manner as described herein.

Thus, the well stabilization methods of the present invention are well adapted to carry out the objects and attain the ends and advantages mentioned as well as those which are inherent therein. While numerous changes to the tools and methods can be made by those skilled in the art, such changes are encompassed within the spirit of this invention as defined by the appended claims.

What is claimed is:

1. A method of stabilizing an unstable hydrocarbon producing zone of a subterranean zone or formation penetrated by a wellbore comprising the steps of:

(a) attaching a well stabilization tool to a drill string, said tool comprising:

a housing having a fluid flow passage in communication with the drill string;

wherein said tool includes one or more ports in fluid communication with said fluid flow passage whereby fluid may be pumped into the drill string and through said one or more ports;

(b) placing said tool within the portion of the wellbore in the unstable zone or formation;

(c) pumping fluid through said one or more ports and into the portion of the wellbore in the unstable zone or formation whereby the diameter of the wellbore is enlarged by fluid jet erosion;

(d) pumping a hardenable permeable material through said one or more ports and into the enlarged portion of the wellbore in the unstable zone or formation whereby the enlarged portion of the wellbore is filled with said hardenable permeable material;

(e) allowing said permeable material to harden within the enlarged portion of the wellbore; and (f) drilling the wellbore through said hardened permeable material and thereafter producing hydrocarbons therefrom.

2. The method of claim 1 further comprising the step of flowing an activator plug with drilling fluid through the drill string wherein said plug causes fluid to be flowed through said one or more ports.

3. The method of claim 1 wherein said permeable material is introduced in step (d) at a rate and pressure sufficient to fracture the unstable zone or formation and place at least a portion of said permeable material in at least one created fracture.

4. The method of claim 1 wherein said permeable material is coated with a hardenable organic resin.

5. The method of claim 4 wherein said resin comprises at least one member selected from the group of novalac resins, polyepoxide resins, polyester resins, phenol-aldehyde resins, urea-aldehyde resins, furan resins and urethane resins.

6. The method of claim 1 wherein said permeable material comprises a graded particulate having a particle size in the range of from about 8 to about 70 mesh on the U.S. Sieve Series.

7. A method of stabilizing an unstable hydrocarbon producing subterranean zone or formation penetrated by a wellbore during the drilling of the wellbore with a drill bit connected to a drill string comprising the steps of:

(a) placing a well stabilization tool in the drill string near the drill bit, said tool having a longitudinal fluid flow passage therethrough, having one or more lateral fluid jet forming ports therein and having an internal valve which can be selectively moved between a first position whereby fluid pumped into the drill string is flowed through said fluid flow passage of said tool and through the drill bit and a second position whereby said fluid is flowed through said lateral fluid jet forming ports of said tool;

(b) drilling the wellbore with said valve of said tool in said first position until the wellbore has been drilled into the unstable hydrocarbon producing subterranean zone or formation;

(c) moving said valve of said tool from said first position to said second position and pumping fluid through said jet forming ports at a rate while moving said tool through at least a portion of the wellbore in the unstable zone or formation whereby the diameter of the wellbore is enlarged by fluid jet erosion;

(d) pumping a hardenable permeable material through the drill string and through said jet forming ports of said tool at a rate while moving said tool through the enlarged portion of the wellbore in the unstable zone or formation whereby the enlarged portion of the wellbore is filled with said hardenable permeable material;

(e) moving said valve of said tool back to said first position while said permeable material is allowed to harden; and (f) drilling the wellbore through said hardened permeable material whereby hydrocarbons can be produced therefrom.

8. The method of claim 7 wherein said valve of said tool is a valve sleeve slidably disposed in said fluid flow passage of said tool which is movable between said first and second positions.

9. The method of claim 8 wherein said valve sleeve is moved from said first position to said second position in accordance with step (c) by flowing an activator plug through the drill string into said tool and into releasable engagement with said valve sleeve whereby said activator plug and valve sleeve are moved by fluid pressure to said second position.

10. The method of claim 8 wherein said valve sleeve is moved back to said first position in accordance with step (e)

by retrieving said activator plug from said tool and drill string whereby said valve sleeve is pulled from said second position to said first position prior to when said activator plug disengages from said valve sleeve.

11. The method of claim 7 wherein said permeable material is coated with a hardenable organic resin.

12. The method of claim 7 wherein said resin comprises at least one member selected from the group of novalac resins, polyexpoxide resins, polyester resins, phenol-aldehyde resins, urea-aldehyde resins, furan resins and urethane resins.

13. The method of claim 1 wherein said permeable material comprises a graded particulate having a particle size in the range of from about 8 to about 70 mesh on the U.S. Sieve Series.

14. A method of stabilizing an unstable hydrocarbon producing subterranean zone or formation penetrated by a wellbore during the drilling of the wellbore comprising the steps of:

(a) placing a well stabilization tool on a drill string, said tool comprising:

a tubular housing having a longitudinal fluid flow passage extending therethrough, having one or more outwardly extending enlarged portions formed thereon whereby the outer surfaces of said enlarged portions are positioned in close proximity to the walls of the wellbore drilled with the drill string and having one or more lateral fluid jet forming ports extending from said fluid flow passage through said enlarged portions of said housing to the exteriors thereof, and a valve sleeve releasably and slidably disposed within said fluid flow passage of said housing and being movable between a first position whereby said fluid jet forming ports are closed by said valve sleeve and fluid pumped through the drill string is free to flow through said housing by way of the interior of said valve sleeve and a second position whereby said fluid jet forming ports are opened;

(b) placing the well stabilization tool within the wellbore in the unstable subterranean zone or formation;

(c) flowing an activator plug with drilling fluid through the drill string and tool housing into releasable engagement with said valve sleeve whereby said activator plug and valve sleeve are moved by drilling fluid pressure from a first position to a second position and drilling fluid is flowed through said lateral fluid jet forming ports;

(d) pumping drilling fluid through said jet forming ports at a rate while moving said tool through the portion of the wellbore in the unstable zone or formation whereby the diameter of that portion of the wellbore is enlarged by jet erosion;

(e) pumping a hardenable permeable material through the drill string and through said jet forming ports at a rate while moving said tool through the enlarged portion of the wellbore in the unstable zone or formation whereby the enlarged portion of the wellbore is filled with said hardenable permeable material; and (f) drilling the wellbore through said hardened permeable material whereby hydrocarbons may be produced therefrom.

15. The method of claim 14 wherein said housing includes three or more lateral fluid jet forming ports.

16. The method of claim 14 wherein said housing includes six or more lateral fluid jet forming ports.

17. The method of claim 14 wherein said permeable material is coated with a hardenable organic resin.

18. The method of claim 14 wherein said resin comprises at least one member selected from the group of novalac resins, polyexpoxide resins, polyester resins, phenol-aldehyde resins, urea-aldehyde resins, furan resins and urethane resins.

19. The method of claim 14 wherein said permeable material comprises a graded particulate having a particle size in the range of from about 8 to about 70 mesh on the U.S. Sieve Series.

* * * * *